US006860112B1

(12) United States Patent
Kobayashi et al.

(10) Patent No.: US 6,860,112 B1
(45) Date of Patent: Mar. 1, 2005

(54) METHOD OF OPERATING VENTILATOR AND AIR CONDITIONER FOR VEHICLE

(75) Inventors: Kenji Kobayashi, Kudamatsu (JP); Tomoyuki Shibuya, Kudamatsu (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 10/791,773

(22) Filed: Mar. 4, 2004

(30) Foreign Application Priority Data

Sep. 3, 2003 (JP) ..... 2003-311797

(51) Int. Cl.[7] ..... F25D 17/06

(52) U.S. Cl. ..... 62/89; 62/241; 454/99; 454/105

(58) Field of Search ..... 62/244, 241, 133, 62/89; 454/99, 105; 165/42, 43

(56) References Cited

U.S. PATENT DOCUMENTS 4,401,149 A * 8/1983 Iijima et al. ..... 165/122
4,804,140 A * 2/1989 Cantrell ..... 236/49.3
5,263,894 A * 11/1993 Hirakawa et al. ..... 454/105
5,333,471 A * 8/1994 Yamada ..... 62/476
5,347,830 A * 9/1994 Yamada ..... 62/481
5,389,035 A * 2/1995 Ishida et al. ..... 454/99
5,477,687 A * 12/1995 Horn ..... 62/6
5,632,156 A * 5/1997 Takeo et al. ..... 62/228.4
5,641,016 A * 6/1997 Isaji et al. ..... 165/43
5,884,497 A * 3/1999 Kishita et al. ..... 62/193
6,347,528 B1 * 2/2002 Iritani et al. ..... 62/324.6

FOREIGN PATENT DOCUMENTS

EP 2000205198 10/2001
JP 358026619 A * 2/1983
JP 405092716 A * 4/1993
JP 1143150 7/2000

* cited by examiner

*Primary Examiner*—William E. Tapolcai
*Assistant Examiner*—Mohammad M. Ali
(74) *Attorney, Agent, or Firm*—Antonelli, Terry, Stout & Kraus, LLP

(57) ABSTRACT

When a vehicle approaches a station, this is detected by means of spot detection and vehicle velocity detection, and operation of a ventilator is slowed down or stopped when the vehicle is at a stop at the station. This allows the numbers of revolutions of an indoor blower, an outdoor blower and a compressor of an air conditioner to be reduced by half, with the heat load being reduced by half. This operation control can reduce the powers of sound sources constituting the interior noise, thereby reducing the interior noise.

3 Claims, 5 Drawing Sheets

METHOD OF OPERATING VENTILATOR AND AIR CONDITIONER FOR VEHICLE

The present application claims priority from Japanese patent application JP2003-311797 filed on Sep. 3, 2003, the content of which is hereby incorporated by reference into this application.

FIELD OF THE INVENTION

The present invention is suitable for operating a ventilator and an air conditioner for a high-speed railway vehicle.

DESCRIPTION OF THE RELATED ART

High-speed vehicles, such as the Shinkansen (bullet train), are hermetically constructed and therefore are provided with a ventilator, which forcedly replaces a predetermined volume of air in the vehicle with the outside air. This ventilator is capable of ventilating the vehicle while keeping the pressure fluctuation in the vehicle to fall within a predetermined range against the compression wave (positive pressure) and the expansion wave (negative pressure) occurring when the vehicle passes through a tunnel.

As described in the patent reference 1, the ventilator has an electric motor with a horizontal rotational shaft, and an exhaust fan (blower) and an intake fan (blower) provided on opposite sides of the electric motor. The exhaust air from the cabin (the interior of the vehicle) is introduced into a casing containing the electric motor and cools the electric motor.

The operating frequency of the ventilator is controlled primarily in accordance with the velocity of the train. In particular, the pressure fluctuation in the train caused by the outside pressure when the train traveling at a high velocity passes another train in a tunnel is suppressed, thereby preventing the passengers from feeling discomfort (pain in the ears).

Furthermore, an air conditioner detects the temperature in the train and controls components thereof, such as an outdoor blower, an indoor blower and a compressor, to keep the temperature in the train at a predetermined temperature. Patent Document 1: Japanese Patent No. 3254428 (EP1143150A1)

With the improvement of living standards, there are increasing demands for greater comfort in high-speed railway vehicles. For more comfort, it has become necessary to reduce the interior noise level of the train both when the train is traveling and when the train is at a stop. When the train is at a stop, the interior noise comes from the following three sound sources:

(1) transmitted sound, which is a noise caused by underfloor devices (air conditioner, ventilator or the like) and transmitted to the interior of the vehicle;

(2) structure-borne sound, which is generated by the vibrations of the underfloor devices (air conditioner, ventilator or the like) vibrating the vehicle body; and (3) flow-induced noise of the conditioning air flowing through an air-conditioning duct provided in the vehicle body.

Therefore, the interior noise level especially when the train is at a stop can be reduced by controlling operations of the underfloor devices based on predetermined information, thereby reducing the levels of the noises due to the three sound sources (1) to (3) described above.

SUMMARY OF THE INVENTION

An object of the present invention is to reduce an interior noise of a vehicle when the vehicle is at a stop.

The object described above is attained by slowing down or stopping the operations of the ventilator and the air conditioner when the vehicle approaches a stop position or when the velocity of the vehicle becomes equal to or lower than a predetermined velocity.

DETAILED DESCRIPTION OF THE PREFERRED EMBODIMENT

An embodiment of the present invention will be described below.

EXAMPLE 1

In the following, one embodiment of the present invention will be described with reference to FIGS. 1 to 5.

Figure 1:
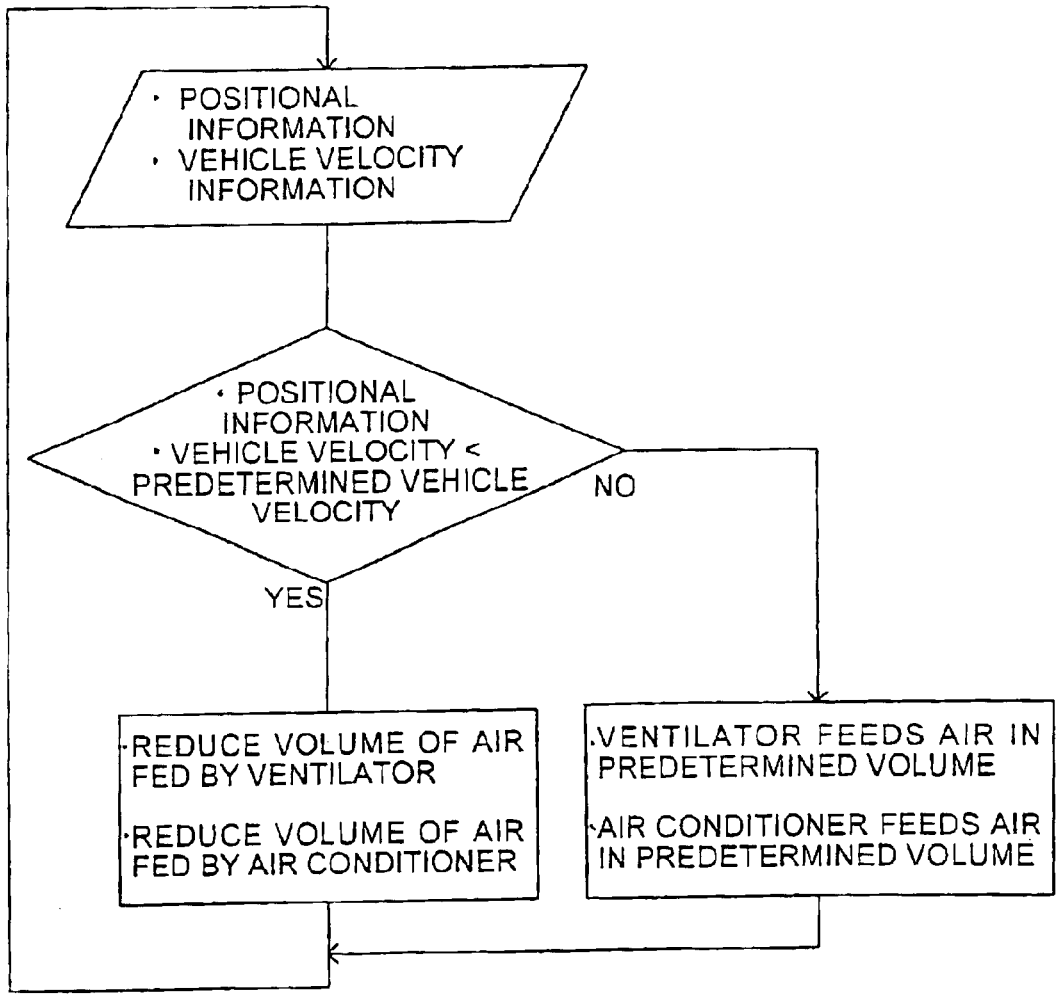
FIG. 1 is a control block diagram for a ventilator and an air conditioner according to an embodiment of the present invention.

FIG. 1 illustrates a method of controlling operations of a ventilator and an air conditioner to reduce an interior noise at the time when a vehicle is at a stop at a station. When the vehicles travels at a high velocity, the interior noise is dominantly constituted by the aerodynamic noise and the rolling noise occurring between the wheels and the rails, and a noise caused by operations of underfloor devices (ventilator, air conditioner or the like) is buried in the above-mentioned noises and can be ignored. On the other hand, when the vehicle travels at a low velocity or is at a stop at a station, the aerodynamic noise and the rolling noise are reduced in level, and thus, the noise caused by operations of the underfloor devices, such as the ventilator and air conditioner, becomes remarkable. Therefore, in order to reduce the interior noise level at the time when the vehicle is at a stop, the noise caused by the underfloor devices must be reduced.

Thus, components of the ventilator and the air conditioner are controlled as shown in FIG. 1. First, a digital automatic train control (ATC) or the like refers to positional information of a train, thereby determining that the deceleration is intended for stopping at a station rather than due to a disruption in the train diagram. Then, based on predetermined positional information or velocity information, the operations of the ventilator (comprising an intake blower and an exhaust blower) and the air conditioner are slowed down, or the volume of air fed by the air conditioner is reduced. If the blowers of the ventilator and the air conditioner are stopped, the noise and vibration caused by operations of the blowers, that is, rotations of the impellers thereof are reduced. Therefore, the transmitted sound and the structure-borne sound transmitted to the interior of the vehicle are suppressed. Besides, the number of revolutions of the indoor blower of the air conditioner is also reduced, so that the flow rates, that is, flow velocities of air-conditioning air and the recycled or exhaust air flowing through a duct provided in the vehicle body are reduced, and thus, the flow-induced noise occurring in the duct can be reduced. The control described above allows the interior noise to be reduced.

Figure 2:
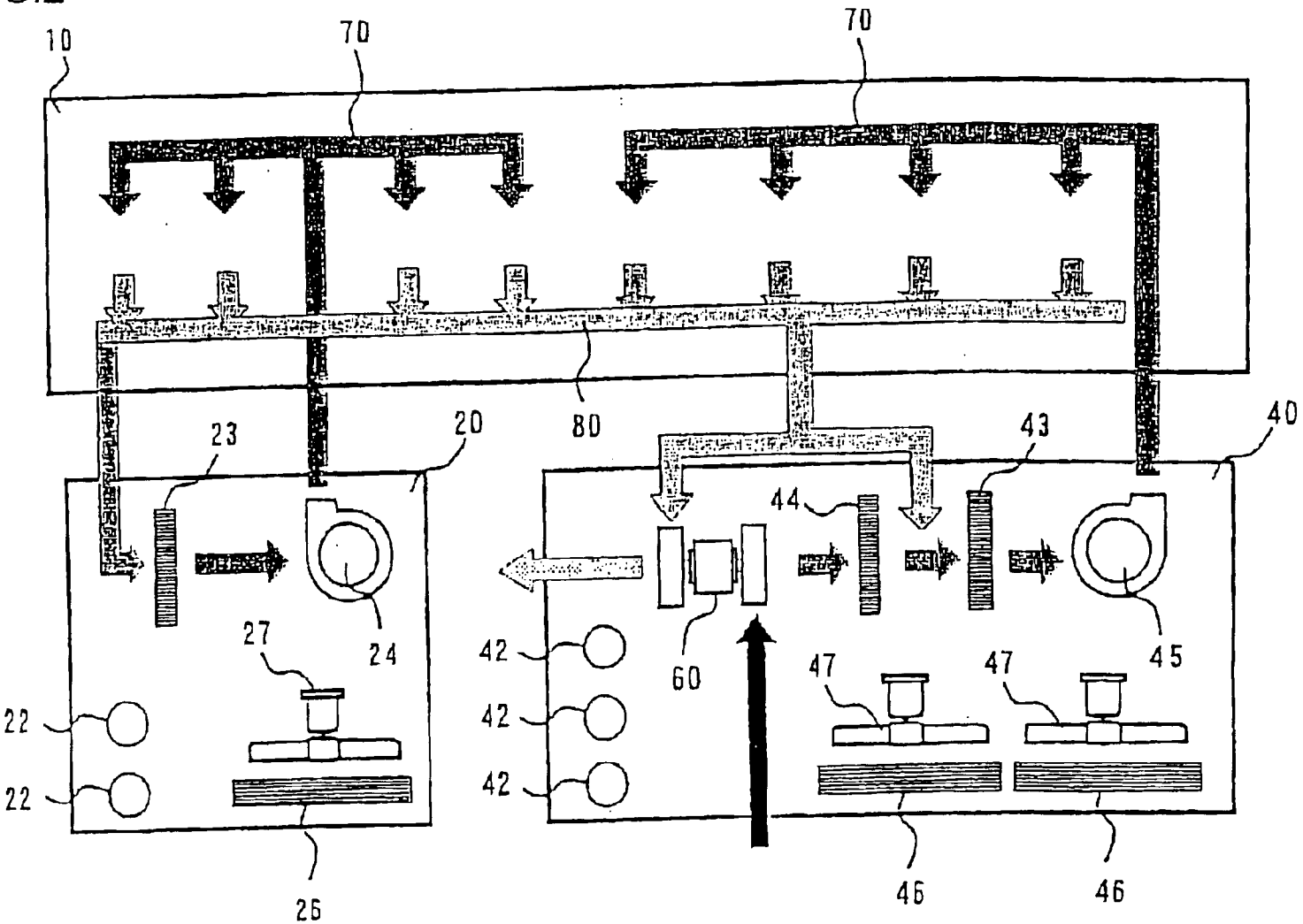
FIG. 2 is a schematic diagram showing components of the ventilator and the air conditioner and a flow of a conditioning air.

FIG. 2 shows a configuration of components of the ventilator and the air conditioner and ducts provided in the vehicle body. A vehicle body 10 is provided with a conditioning air duct 70 and a recycled air/exhaust air duct 80. The space between the ducts represents the interior of the vehicle, that is, a cabin. Since a high-speed railway vehicle typically has an elongated shape, two air conditioners (20, 40) are provided under the floor, thereby facilitating supply of the conditioning air to an end (deck) of the vehicle. In the example shown in FIG. 2, the air conditioner 40 located rearward in the direction of travel has a ventilating blower (ventilator) 60 installed therein. Since the air conditioner 40 incorporates the ventilator 60, a duct which would otherwise be needed to supply fresh air from the ventilator 80 to the air conditioner 40 can be omitted, and thus, the air-conditioning ventilation system can be reduced in weight. When it is determined with the aid of spot detection that the deceleration of the vehicles is intended for stopping at a station as described above, the number of revolutions of the ventilating blower (ventilator) 60 is first reduced. Then, the numbers of revolutions of indoor blowers 24 and 45 and outdoor blowers 27, 47 and 47 are reduced. As required, the numbers of revolutions of compressors 22, 22, 42, 42 and 42 are also reduced. The operations of the air conditioners 20 and 40 are reduced by half. Specifically, the numbers of revolutions of the air conditioners are reduced to about 40% to 60%. The air conditioner 20 has a plurality of compressors 22, an outdoor heat exchanger 26 and an indoor heat exchanger 23. The air conditioner 40 has three compressors 42, 42 and 42. In addition, the air conditioner 40 has a plurality of outdoor heat exchangers 46 and 46 and a plurality of outdoor blowers 47 and 47 and a plurality of indoor heat exchangers 43 and 44.

By the control described above, the levels of the noises and vibrations caused by the indoor blowers 24 and 45, the outdoor blowers 27 and 47, the compressors 22 and 42 and the ventilating blower 60, which are sound sources of the air conditioners can be reduced. In addition, as the numbers of revolutions of the indoor blowers 24 and 45 are reduced, the flow rates, that is, flow velocities of the air flowing through the conditioning air duct 70 and the air flowing through the recycled air/exhaust air duct 80 are reduced, and therefore, the noise caused by the air is also reduced. In this way, the transmitted sound, the structure-borne sound and the flow-induced noise in the ducts, which dominantly constitute the interior noise, are all reduced, and thus, the interior noise level can be reduced.

Figure 3:
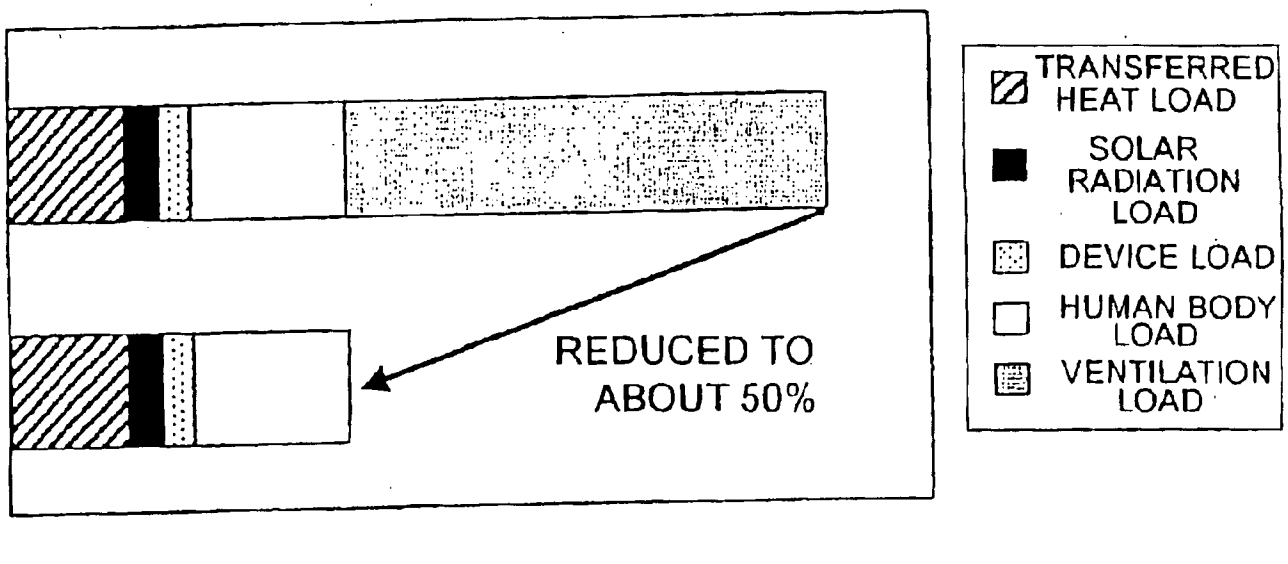
FIG. 3 shows an exemplary heat load on a vehicle body for comparison.

FIG. 3 shows one example of a breakdown of heat load on the vehicle body. FIG. 3 shows an exemplary heat load in the case where the exterior temperature is 40° C. and the interior temperature is 26° C. The heat load comprises a transferred heat load, a solar radiation load, a device load, a human body load and a ventilation load. The ventilation load constitutes the largest part, about a half, of the total heat load. In general, the air conditioner has a cooling capacity allowing for additional several percents of the heat load. Since the ventilating blower (ventilator) 60 is first stopped based on the positional information and velocity information about the vehicle as described above, the ventilation load is reduced to approximately 0, and the heat load on the vehicle body is reduced by half. Therefore, the air conditioners 20 and 40 can keep the interior temperature at about 26° C. with about a half of the predetermined cooling capacity. Thus, even if the operating frequencies of the components of the air conditioners are reduced by half (that is, even if the cooling capacities thereof are reduced by half) to reduce the interior noise, the temperature in the vehicle will not increase immediately, so that the comfort of the passengers of the vehicle is not compromised.

Figure 4:
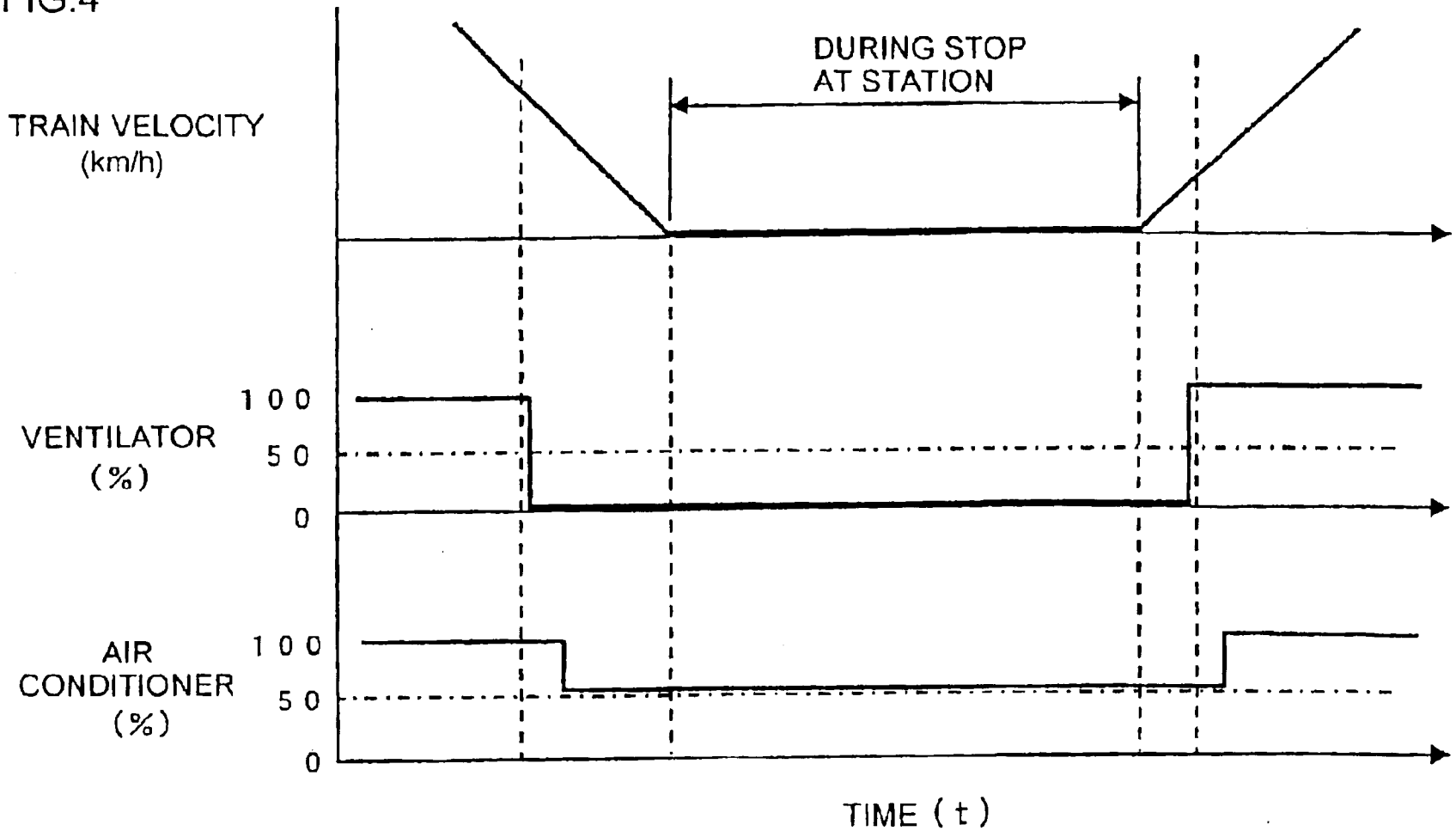
FIG. 4 is an exemplary control timing chart for the train velocity, the ventilator and the air conditioner.

FIG. 4 is a control timing chart for the train velocity, the ventilator and the air conditioners. In process of deceleration of the train for stopping at a station, the train velocity or train position is detected, and the ventilator is first stopped. Thus, the ventilation load contributing about a half of the heat load on the vehicle body is reduced to approximately 0. Then, the air conditioners are operated with a half of a rated power. The numbers of revolutions of the compressors, the outdoor blowers and the indoor blowers are reduced approximately by half. By controlling the ventilator and the air conditioners in this control sequence, the interior noise can be reduced significantly compared to conventional techniques while avoiding increase in temperature in the vehicle. Furthermore, since the numbers of revolutions of the outdoor blowers are reduced, the exterior noise can be advantageously reduced when the train is at a stop at the station. Concurrently with departure of the train, the ventilator is activated again, and subsequently, the air conditioners are activated again. Here, the order of activations may be altered, and the air conditioners may be activated prior to activating the ventilator.

Figure 5:
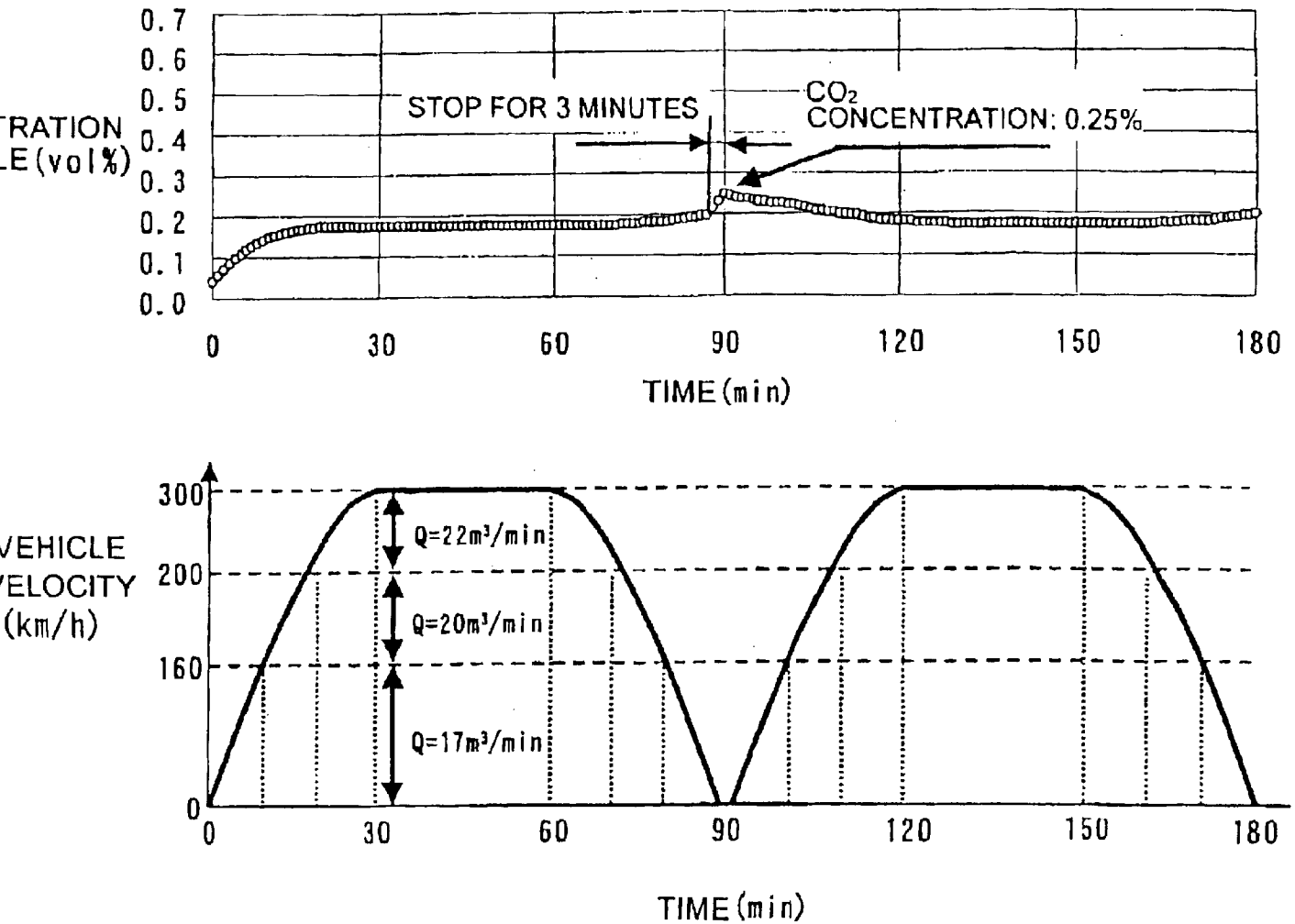
FIG. 5 shows a transition of the $CO_2$ concentration in the vehicle and a train diagram.

FIG. 5 shows an exemplary train diagram and a transition of the $CO_2$ concentration in the vehicle in the case where the ventilator is suspended for 3 minutes during which the vehicle is at a stop at a station according to the train diagram. According to the train diagram, the maximum velocity is 300 km/h, and one operation takes about 3 hours and includes one stop at a station. The vehicle velocity is previously detected, and based on the vehicle velocity, the number of revolutions of the ventilator is controlled, and the ventilation air volume is adjusted. The normal accommodation capacity is 100 passengers, and the maximum ventilation air volume is 22 $m^3$/min. In 3 minutes immediately before stopping at the station, the ventilator is stopped to reduce the ventilation load (part of the heat load on the vehicle body) to reduce by half the powers of the air conditioners to reduce the interior noise. Until the time when the ventilator is stopped, the $CO_2$ concentration in the vehicle is about 0.2% by volume. During the period of 3 minutes in which the ventilator is not operated, the $CO_2$ concentration in the vehicle increases to about 0.25% by volume. This value does not take into consideration the ventilation through the entrance doors, and therefore, the actual $CO_2$ concentration in the vehicle is considered to be slightly lower than this value. Then, concurrently with departure of the train, the ventilator is activated again, and thus, the $CO_2$ concentration in the vehicle is reduced to about 0.2% by volume in about 15 minutes. According to the Ordinance on Hygienic Standards in Office Rooms, the $CO_2$ concentration of up to 0.5% volume is permitted for 8 hours of residence time, and the $CO_2$ concentration of about 0.25% by volume will not immediately affect the health of the passengers.

What is claimed is:

1. A method of operating a ventilator and an air conditioner for a vehicle, the ventilator comprising an intake blower for feeding an outside air into the vehicle and an exhaust blower for discharging the air in said vehicle to the outside of the vehicle, and the air conditioner comprising an outdoor blower for feeding air to an outdoor heat exchanger, an indoor blower for feeding the air passing through an indoor heat exchanger into the vehicle and a compressor for circulating a coolant in a cooling cycle, wherein when said vehicle approaches a stop position, or when the velocity of said railway vehicle is equal to or lower than a predetermined velocity, operations of said ventilator and said air conditioner are slowed down or stopped.

2. The method of operating a ventilator and an air conditioner for a vehicle according to claim 1, wherein when the vehicle approaches a stop position, or when the velocity of said vehicle is equal to or lower than a predetermined velocity, operation of said ventilator is stopped, and operation of said air conditioner is slowed down approximately by half.

3. The method of operating a ventilator and an air conditioner for a vehicle according to claim 1, wherein based on information about the position of the traveling vehicle, it is determined that said predetermined velocity is attained, from the fact that the vehicle has approached a next stop position.

* * * * *